US009441463B2

(12) United States Patent
Cunningham et al.

(10) Patent No.: US 9,441,463 B2
(45) Date of Patent: Sep. 13, 2016

(54) WELL SCREEN WITH CHANNEL FOR SHUNT OR CABLE LINE

(71) Applicant: Halliburton Energy Services, Inc., Houston, TX (US)

(72) Inventors: Gregory Scott Cunningham, Grapevine, TX (US); Stephen Michael Greci, McKinney, TX (US); Jean Marc Lopez, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 146 days.

(21) Appl. No.: 13/928,314

(22) PCT Filed: Oct. 26, 2012

(86) PCT No.: PCT/US2012/062123

§ 371 (c)(1),
(2) Date: Jun. 26, 2013

(87) PCT Pub. No.: WO2014/065815

PCT Pub. Date: May 1, 2014

(65) Prior Publication Data

US 2014/0116727 A1 May 1, 2014

(51) Int. Cl.
*E21B 43/08* (2006.01)
*E21B 17/02* (2006.01)

(52) U.S. Cl.
CPC ..... *E21B 43/08* (2013.01); *E21B 17/026* (2013.01); *Y10T 29/49826* (2015.01); *Y10T 29/49908* (2015.01)

(58) Field of Classification Search
CPC .... E21B 43/08; E21B 43/082; E21B 43/084; E21B 43/086; E21B 43/088; E21B 17/026; E21B 17/023
See application file for complete search history.

(56) References Cited

U.S. PATENT DOCUMENTS

| | | | | |
|---|---|---|---|---|
| 5,664,628 | A | 9/1997 | Koehler et al. | |
| 6,382,318 | B1 | 5/2002 | Whitlock | |
| 6,863,131 | B2 * | 3/2005 | Richard | 166/384 |
| 7,073,601 | B2 * | 7/2006 | Cameron | 166/381 |
| 7,222,676 | B2 * | 5/2007 | Patel et al. | 166/378 |
| 7,497,257 | B2 * | 3/2009 | Hopkins et al. | 166/278 |
| 7,841,409 | B2 * | 11/2010 | Gano et al. | 166/278 |
| 2002/0088744 | A1 | 7/2002 | Echols et al. | |
| 2002/0092649 | A1 | 7/2002 | Bixenman et al. | |
| 2003/0056947 | A1 | 3/2003 | Cameron | |

(Continued)

FOREIGN PATENT DOCUMENTS

EP 2395197 A2 12/2011

OTHER PUBLICATIONS

Examination Report issued from the Intellectual Property Office of Great Britain regarding related patent application No. GB1505934.8 dated Sep. 17, 2015, 3 pages.

(Continued)

*Primary Examiner* — Elizabeth Gitlin
(74) *Attorney, Agent, or Firm* — Haynes and Boone, LLP

(57) ABSTRACT

A downhole well screen has a base pipe with a filter mounted thereon with the filter comprising plurality of spaced layers including a screen layer. A longitudinally extending channel is formed in the well screen by plastically deforming the filter. The channel is selected to be of a size and shape to accommodate well control lines.

16 Claims, 2 Drawing Sheets

(56) References Cited

U.S. PATENT DOCUMENTS

| | | | | |
|---|---|---|---|---|
| 2005/0044690 | A1* | 3/2005 | Gillespie et al. | 29/521 |
| 2010/0258301 | A1 | 10/2010 | Bonner et al. | |

OTHER PUBLICATIONS

Examination Report No. 1 issued from IP Australia regarding related patent application No. 2012392949 dated Nov. 19, 2015, 3 pages.

Search Report and Written Opinion issued from the Intellectual Property Office of Singapore regarding related Singapore patent application No. 11201502580T dated Jan. 5, 2016, 9 pages.

Search Report and Written Opinion issued from the Korean Intellectual Property Office regarding related International application No. PCT/US2012/062123 dated Apr. 30, 2013, 6 pages.

Notification of Grant issued from the Intellectual Property Office of the UK regarding related Great Britain patent application No. GB1505934.8 dated Feb. 16, 2016, 2 pages.

Examiner's Letter issued from the Canadian Intellectual Property Office regarding related Canadian application No. 2889134 dated Mar. 29, 2016, 4 pages.

* cited by examiner

WELL SCREEN WITH CHANNEL FOR SHUNT OR CABLE LINE

CROSS-REFERENCE TO RELATED APPLICATIONS

Not applicable.

STATEMENT REGARDING FEDERALLY SPONSORED

Not applicable.

RESEARCH OR DEVELOPMENT

Not applicable.

REFERENCE TO A MICROFICHE APPENDIX

Not applicable.

BACKGROUND

The present invention relates to downhole well screens and, more particularly, to screens used in well having hydraulic and electrical control lines extending therein. Still, more particularly, the present invention relates to a well screen having a longitudinally extending channel formed in the exterior of screen for receiving control lines.

Well filters are typically used in subterranean well environments in which it is desired to remove a liquid or gas from the ground, without bringing soil particulates, such as sand or clay, up with the liquid or gas. A well filter generally includes an inner support member, such as a perforated core or base pipe and a filter body, including a filter medium disposed around the inner support member. In many cases, the well filter will further include an outer protective member, such as a perforated cage or shroud, disposed around the filter body for protecting it from abrasion and impacts. A filter for subterranean use is described in U.S. Pat. No. 6,382,318, which is hereby incorporated herein by reference for all purposes. A downhole screen and method of manufacture is described in U.S. Pat. No. 5,305,468, which is hereby incorporated herein by reference for all purposes.

It is desirable to be able to suspend control lines in the well to operate valves and other downhole equipment. Downhole well screens, when present, typically are designed to fill the entire wellbore and accordingly cannot be used with control lines in that they do not provide clearance for control lines.

Accordingly, there is a need for improved well screen design and method of manufacturing a well screen with clearance for a well control line to extend through the well, past the well screen.

SUMMARY

Disclosed herein is a subterranean well screen assembled with a longitudinally extending external channel for receiving an electrical or hydraulic control line. The screen can be formed in a conventional manner and then plastically deformed to create a longitudinally extending channel for to provide clearance for a control line.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
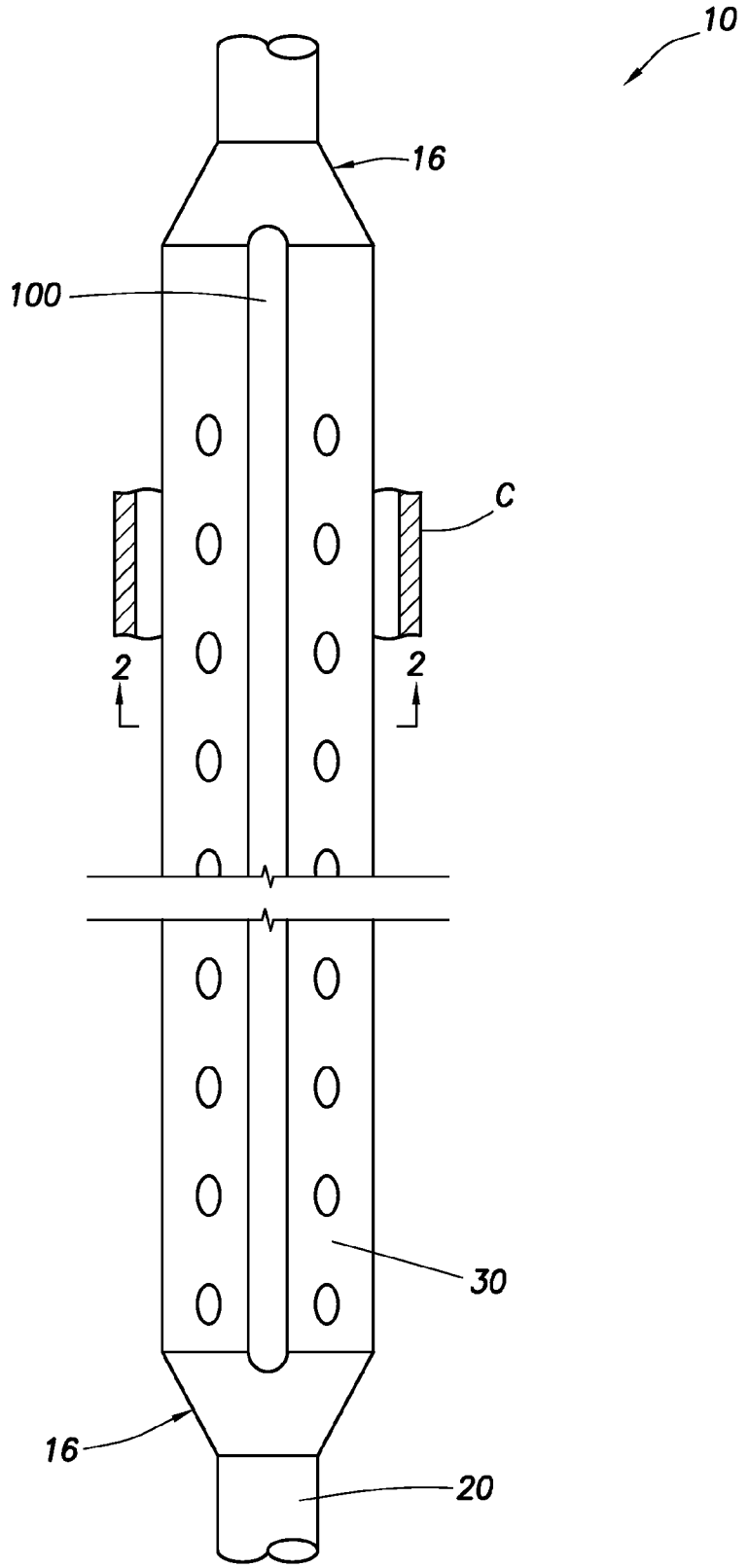
FIG. 1 is a side view of the sand screen, according to the present invention.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." Reference to "up" or "down" will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone," as used herein, refers to separate parts of the wellbore designated for treatment or production and may refer to an entire hydrocarbon formation or separate portions of a single formation, such as horizontally and/or vertically spaced portions of the same formation.

The various characteristics mentioned above, as well as other features and characteristics described in more detail below, will be readily apparent to those skilled in the art with the aid of this disclosure upon reading the following detailed description of the embodiments and by referring to the accompanying drawings.

Figure 2:
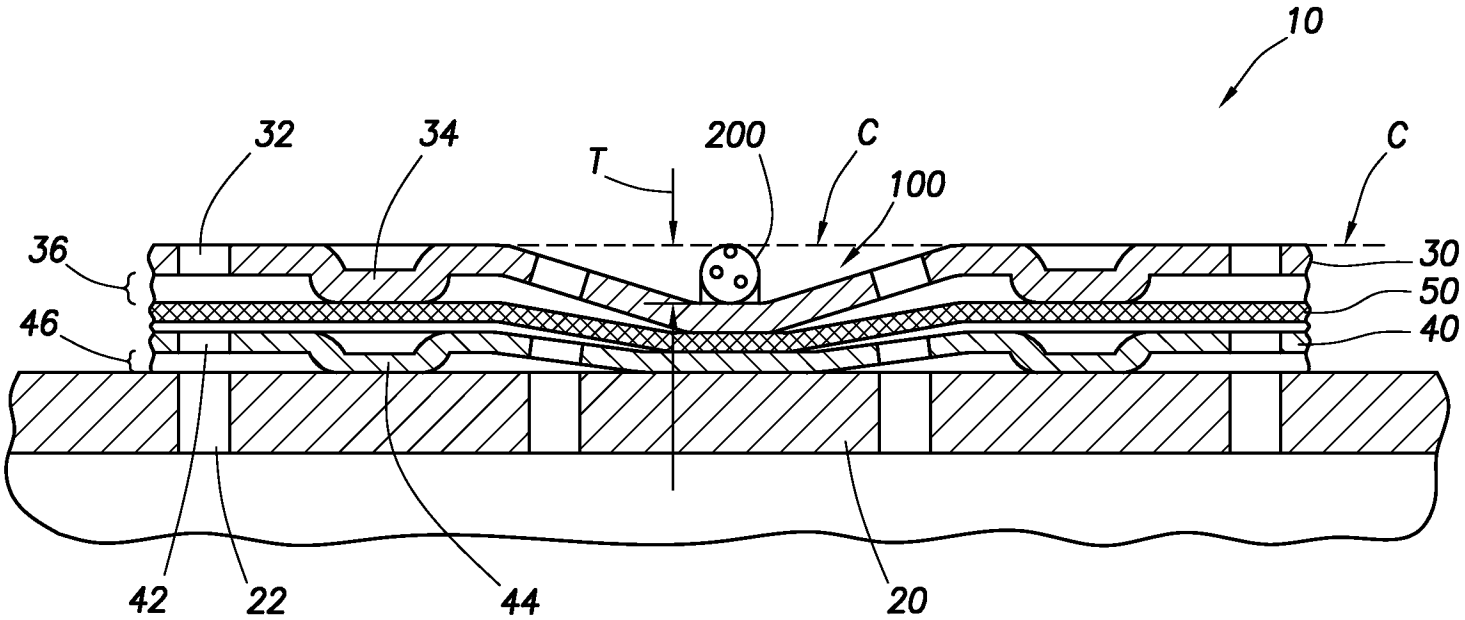
FIG. 2 is an enlarged, cross-sectional view of the sand screen taken on line 2-2 of FIG. 1, looking in the direction of the arrows.

Referring now to the drawings, wherein like reference characters are used throughout the several views to indicate like or corresponding parts, there is illustrated in FIGS. 1 and 2, a sand screen assembly 10 for use in a wellbore at a subterranean location inside a cased or uncased wellbore C. In the disclosed embodiment, the wellbore sand screen assembly comprises an elongated base pipe 20 of sufficient structural integrity to be connected to a tubing string. Typically threads are provided on the ends of the base pipe. Base pipe 20 supports concentric outer filter layers including: a tubular outer shroud 30, a tubular inner shroud 40, and a tubular screen layer 50. As used in regard to the screen layers the terms "annular" or "tubular" refer to a structure having a hollow center without regard to the outer shape.

As hydrocarbon production (fluids and gasses) and other fluids flow from wellbore area outside of the screen assembly 10 into the base pipe, sand and other solid particles are trapped by the screen layer 50. Preferably, the screen layer has a pore size selected to filter particles from the flowing fluids.

In FIG. 2, screen layer 50 is illustrated as a single mesh layer; however the filter layer could comprise multiple layers, for example, a woven sand screen material sandwiched between two separate mesh drainage layers. It is envisioned, however, that filter layer could include an outer relatively coarse wire mesh drainage layer, a relatively fine wire mesh filtering layer, and an inner relatively coarse wire mesh drainage layer all of which are positioned between the outer and inner shrouds 30 and 40, respectively.

The base pipe 20 includes perforations 22, extending through the wall of the base pipe 20 along the length between the crimped ends 16. As used herein, the term "perforation" is not intended to be cross section shaped limiting and includes all shapes including, for example, perforations which are circular, oblong, and slit shaped. As is well known in the industry, these openings in the base pipe need only be of a sufficient size and shape to facilitate flow without destroying the structural integrity of the base pipe.

As best illustrated in FIG. 2, the outer shroud 30 is tubular shaped and includes a plurality of perforations 32 to allow hydrocarbon fluids to flow into the screen assembly 10. Preferably, the outer shroud 30 is also provided with a plurality of deformations 34 which extend radially from the inner wall of the outer shroud 30. These deformations 34 hold the screen layer 50 off of the internal surface of the outer shroud and form what is known in the industry as a drainage layer. In this configuration the outer shroud has an integrally formed drainage layer. This annular space defining a drainage layer is identified in FIG. 2 by reference numeral 36. If an outer shroud is used without the deformations, drainage layer 36 can be formed by adding a mesh layer (not shown).

The inner shroud 40 is of a similar tubular construction. Perforations 42 extend through the wall of the shroud and deformations 44 extend inwardly against the base pipe 20 to form another drainage layer 42. In other embodiments, the drainage layers can be created using a material layers that causes the layers of the screen to remain spaced apart.

Well screens are assembled in various ways. The outer layers of the well screen can be prepared in the shape of a cylinder and the layers can be telescoped over the base pipe. In other methods, the outer layers are wrapped around the base pipe. The outer layers of the sand screen assembly 10 can have their ends crimped onto the base pipe 20, as indicated by reference numeral 16.

According to an improvement of this invention, one or more longitudinally extending channels 100 are formed in the exterior of the sand screen 10. In the present embodiment channel 100 is formed by compressing the drainage layers and plastically deforming the filter layers inward against the base pipe 20 resulting in a channel having a depth "T". The channels 100 extend longitudinally the length of the screen between the crimped portions. The shape of the channel can take on the shape of the tool used to deform the screen assembly. It is expected that the material properties will cause the channel to have a somewhat curved cross section.

In the longitudinally extending area of the filter below the channel, the thickness of the screen is reduced by plastic deformation of the screen material. The screen is compressed to the thickness of the material forming the screen and any deformation of the material cross section.

Any deformations 32 and 42 in this area under the channel are plastically deformed or flattened to the material thickness of the shroud. This compresses or eliminates the drainage layers 36 and 46 under the channel. Thus, shrouds that have integrally formed drainage layers (as illustrated in FIG. 2), are deformed to compress the drainage layers. Also, any mesh type drainage layers are radially compressed and plastically deformed to the thickness of the material forming the layers.

Channel 100 extends the length of the uncrimped outer surface of the screen and is of a size and shape to accommodate a control line 200. The sand screen can be assembled in the string and placed in the well in a subterranean location with the control line extending through the channel 100.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of making a well screen for filtering solids from production fluids at a subterranean well location, having a control line extending there through, the method comprising the steps of:

providing an elongated base pipe with connections on each end to connect the base pipe in fluid communication with a tubing string, the base pipe having perforations in the wall along a portion of the length of the base pipe;

attaching an annular-shaped filtering assembly around the perforated portion of the base pipe; the filtering assembly comprising:

an annular screen for filtering solids from production fluids; and an inner annular shroud positioned between the annular screen and the base pipe, wherein the inner annular shroud comprises an annular wall, wherein a first portion of the annular wall engages the base pipe and a second portion of the annular wall is offset from the base pipe to form a first drainage layer between the second portion of the wall and the base pipe when the filtering assembly is in an uncompressed position; and compressing, to a compressed position, the annular-shaped filtering assembly inward against the base pipe to form a longitudinally extending channel in the outer surface of the filtering assembly of a size and shape to receive the control line and to plastically deform the filtering assembly such that the second portion of the annular wall engages the base pipe:

wherein the first portion of the annular wall is different from the second portion of the annular wall.

2. The method of claim 1, wherein attaching the annular-shaped filtering assembly around the perforated portion of the base pipe comprises crimping the ends of filtering assembly to the base pipe.

3. The method of claim 1, further comprising:

connecting the well screen to the tubing string and positioning the well screen at the subterranean well location, wherein the control line extends through the subterranean well location; and positioning the control line in the longitudinally extending channel whereby the control line extends past the well screen.

4. The method of claim 1, wherein the filtering assembly further comprises an outer annular shroud positioned around the screen to protect the screen, the outer annular shroud having perforations formed therethrough.

5. The method of claim 4, wherein attaching the annular-shaped filtering assembly around the perforated portion of the base pipe comprises crimping the ends of the filtering assembly to the base pipe.

6. The method of claim 1, wherein the filtering assembly further comprises an outer annular shroud positioned around the annular screen to protect the annular screen and the first drainage layer, the outer annular shroud having perforations formed therethrough.

7. The method of claim 6, wherein attaching the annular-shaped filtering assembly around the perforated portion of the base pipe comprises crimping the ends of the filtering assembly to the base pipe.

8. The method of claim 1, wherein the filtering assembly further comprises an outer annular shroud positioned around the annular screen to protect the annular screen and a second drainage layer formed between the annular screen and the outer annular shroud, the outer annular shroud having perforations formed therethrough.

9. The method of claim 8, wherein attaching the annular-shaped filtering assembly around the perforated portion of the base pipe comprises crimping the ends of the filtering assembly to the base pipe.

10. The method of claim 8, wherein compressing the annular-shaped filtering assembly inward against the base pipe comprises compressing the first and second drainage layers.

11. A well screen for filtering solids from production fluids at a subterranean well location, having a control line extending there through, the well screen comprising:

an elongated base pipe with connections on each end to connect the base pipe in fluid communication with a tubing string, perforations in the wall of a portion of the base pipe;

a tubular filter assembly that is compressible from an uncompressed position to a compressed position, the assembly comprising:

a screen mounted around the base pipe; and an inner annular shroud positioned between the screen and the base pipe, the inner annular shroud comprising an annular wall, wherein a first portion of the annular wall engages the base pipe;

wherein, when the filter assembly is in the uncompressed position, a second portion of the annular wall is offset from the base pipe to form a first drainage layer between the second portion of the annular wall and the base pipe; and wherein, when the filter assembly is in the compressed position, the second portion of the annular wall engages the base pipe; and a longitudinally extending channel in the tubular filter assembly of a size and shape to receive a control line therein;

wherein the longitudinally extending channel corresponds with a portion of the inner annular shroud in which the second portion of the annular wall engages the base pipe when the filter assembly is in the compressed position; and wherein the first portion of the annular wall is different from the second portion of the annular wall.

12. The well screen according to claim 11, wherein the filter assembly is mounted on the base pipe by crimping the ends of the filter assembly onto the base pipe.

13. The well screen according to claim 11, wherein the filter assembly further comprises an outer annular shroud mounted on the base pipe and around the screen, wherein the outer annular shroud is a perforated annular shroud having an exterior surface that forms an outer wall of the well screen; wherein an annular space is formed between an interior surface of the outer annular shroud and an exterior surface of the base pipe; and wherein the screen is mounted in the annular space.

14. The well screen according to claim 13, wherein the filter assembly is mounted on the base pipe by crimping the ends of the filter assembly onto the base pipe.

15. The well screen according to claim 11, wherein the screen is an annular screen for filtering solids from production fluids, and wherein the outer annular shroud is positioned around the annular screen to protect the annular screen and the first drainage layer and a second drainage layer formed between the annular screen and the outer annular shroud, the outer annular shroud having perforations formed therethrough.

16. The well screen according to claim 15, wherein the annular screen is a plastically-deformed screen; and wherein the second drainage layer is compressed.

* * * * *